United States Patent [19]

Miller et al.

[11] Patent Number: 4,744,890

[45] Date of Patent: May 17, 1988

[54] FLOTATION APPARATUS AND METHOD

[75] Inventors: Jan D. Miller; David J. Kinneberg, both of Salt Lake City, Utah

[73] Assignee: University of Utah, Salt Lake City, Utah

[21] Appl. No.: 842,697

[22] Filed: Mar. 21, 1986

Related U.S. Application Data

[63] Continuation of Ser. No. 680,613, Dec. 11, 1984, abandoned, which is a continuation of Ser. No. 465,748, Feb. 11, 1983, abandoned, which is a continuation-in-part of Ser. No. 323,336, Nov. 20, 1981, Pat. No. 4,397,741, which is a continuation-in-part of Ser. No. 182,524, Aug. 29, 1980, Pat. No. 4,399,027, which is a continuation-in-part of Ser. No. 94,521, Nov. 15, 1979, Pat. No. 4,279,743.

[51] Int. Cl.[4] ..... B03D 1/02; B04C 5/103; B04C 5/16

[52] U.S. Cl. ..... 209/164; 209/170; 209/211; 210/512.1; 210/221.2; 210/788; 261/122

[58] Field of Search ..... 209/164, 168, 170, 211, 209/144; 210/221.2, 512.1, 512.2, 512.3, 787, 730; 261/122, DIG. 75; 55/459 R, 459 A, 459 B, 459 C, 459 D, 460

[56] References Cited

U.S. PATENT DOCUMENTS

| | | | |
|---|---|---|---|
| 1,149,463 | 8/1915 | Pardee . | |
| 1,420,138 | 6/1922 | Peck . | |
| 1,420,139 | 6/1922 | Peck . | |
| 1,869,732 | 8/1932 | Asselstine . | |
| 2,054,643 | 9/1936 | Tucker | 209/170 |
| 2,354,311 | 7/1944 | Harlow | 209/144 |

(List continued on next page.)

FOREIGN PATENT DOCUMENTS

| | | | |
|---|---|---|---|
| 2740463 | 8/1964 | Australia . | |
| 274774 | 5/1967 | Australia | 210/512.1 |
| 1105166 | 3/1968 | Australia . | |
| 0029553 | 11/1980 | European Pat. Off. . | |
| 1175621 | 8/1964 | Fed. Rep. of Germany . | |
| 2748478 | 5/1978 | Fed. Rep. of Germany . | |
| 2812105 | 9/1979 | Fed. Rep. of Germany . | |
| 998240 | 1/1952 | France . | |
| 1022375 | 3/1953 | France . | |
| 60294 | 10/1954 | France . | |
| 1249814 | 11/1960 | France . | |
| 1356704 | 2/1964 | France . | |
| 2263036 | 3/1975 | France . | |
| 226259 | 4/1969 | Sweden . | |
| 1005479 | 2/1964 | United Kingdom . | |
| 1177176 | 3/1967 | United Kingdom . | |
| 1500117 | 2/1978 | United Kingdom . | |
| 545385 | 3/1977 | U.S.S.R. . | |
| 751437 | 7/1980 | U.S.S.R. . | |

OTHER PUBLICATIONS

A. Bahr et al., "The Development and Introduction of a New Coal Flotation Cell", Report of the Fourteenth International Mineral Processing Congress (Oct. 17–23, 1982).

William E. Foreman, "The Flotation of Slimes," Canadian Mining Manual, 98–101.

*Primary Examiner*—S. Leon Bashore
*Assistant Examiner*—Thomas M. Lithgow
*Attorney, Agent, or Firm*—Workman, Nydegger & Jensen

[57] ABSTRACT

Flotation apparatus and methods for separating particles from particulate suspensions such as coal and mineral ore slurries, wherein fluid discharge is removed annularly from a flotation vessel. Preferably, the flotation apparatus includes a vertically oriented, cylindrical flotation vessel having a tangential inlet at its upper end and an annular outlet at its lower end. The annular outlet allows for the smooth exit of fluid discharge from the flotation vessel so as to avoid disturbance of the fluid flow within the flotation vessel. The apparatus includes a froth pedestal positioned within the lower end of the vessel which forms the annular outlet with the wall of the vessel. The froth pedestal further serves to support a froth column formed within the flotation vessel and isolates the froth column from the fluid discharge so as to minimize mixing therebetween.

8 Claims, 3 Drawing Sheets

U.S. PATENT DOCUMENTS

| | | | |
|---|---|---|---|
| 2,532,885 | 12/1950 | Berges | 92/28 |
| 2,538,870 | 1/1951 | Hunter | 196/19 |
| 2,757,581 | 8/1956 | Freeman et al. | 92/28 |
| 2,816,490 | 12/1957 | Boadway et al. | 92/28 |
| 2,829,771 | 4/1958 | Dahlstrom | 209/211 |
| 2,849,930 | 9/1958 | Freeman et al. | 92/28 |
| 2,879,889 | 3/1959 | Rakowsky | 209/173 |
| 2,917,173 | 12/1959 | Rakowsky | 209/172.5 |
| 3,052,361 | 9/1962 | Whatley et al. | 210/512 |
| 3,130,157 | 4/1964 | Kelsall et al. | 210/512 |
| 3,219,186 | 11/1965 | Polhemus et al. | 209/172.5 |
| 3,349,548 | 10/1967 | Boyen | 55/457 |
| 3,391,787 | 7/1968 | Salomon | 210/84 |
| 3,426,513 | 2/1969 | Bauer | 55/459 R |
| 3,443,932 | 5/1969 | Melin et al. | 75/101 |
| 3,446,353 | 5/1969 | Davis | 209/164 |
| 3,452,870 | 7/1969 | Katsuta et al. | 210/94 |
| 3,489,680 | 1/1970 | Snavely, Jr. | 210/23 |
| 3,557,956 | 1/1971 | Braun | 210/84 |
| 3,615,008 | 10/1971 | Alpha | 209/139 A |
| 3,687,286 | 8/1972 | Weiss | 209/211 |
| 3,759,385 | 9/1973 | Pouillon | 209/165 |
| 3,802,570 | 4/1974 | Dehne | 210/304 |
| 3,844,414 | 10/1974 | Jordison | 209/467 |
| 4,005,998 | 2/1977 | Gorman | 55/459 R |
| 4,031,006 | 6/1977 | Ramirez et al. | 210/44 |
| 4,076,507 | 2/1978 | Hauberg | 55/459 R |
| 4,097,375 | 6/1978 | Molitor | 210/23 H |
| 4,165,841 | 8/1979 | Musselmann et al. | 241/46.02 |
| 4,208,276 | 6/1980 | Bahr | 209/168 |
| 4,213,730 | 7/1980 | Brooks et al. | 209/168 |
| 4,216,095 | 8/1980 | Ruff | 210/512 R |
| 4,279,741 | 7/1981 | Campbell | 209/44 |
| 4,279,743 | 7/1981 | Miller | 209/211 |
| 4,397,741 | 8/1983 | Miller | 209/170 |
| 4,399,027 | 8/1983 | Miller | 209/164 |
| 4,597,859 | 7/1986 | Beck | 210/512.1 X |

FLOTATION APPARATUS AND METHOD

This application is a continuation of Ser. No. 680,613 filed 12-11-84 (Now Abandoned) which is a continuation of Ser. No. 465,748 filed 2-11-83 (Now Abandoned); which is a C-I-P of Ser. No. 323,336 filed 11-20-81 (Now U.S. Pat. No. 4,397,741); which is a C-I-P of Ser. No. 182,524 filed 8-29-80 (Now U.S. Pat. No. 4,399,027); which is a C-I-P of Ser. No. 094,521 filed 11-15-79 (Now U.S. Pat. No. 4,279,743).

BACKGROUND

1. Field of the Invention

The present invention relates to flotation apparatus and methods for use in the separation of particles from a particulate suspension. More particularly, the present invention relates to flotation apparatus and methods wherein separation is achieved in a centrifugal field and wherein fluid discharge is removed annularly from the flotation vessel.

2. The Prior Art

A. Flotation Systems

Flotation is a process in which one or more specific particulate constituents of a slurry or suspension of finely dispersed particles become attached to gas bubbles so that they can be separated from the other constituents of the slurry or suspension. The buoyancy of the bubble/particle aggregate, formed by the adhesion of the gas bubble to a particle in the slurry, is such that is rises to the surface of the flotation vessel where it is separated from the remaining particulate constituents which remain suspended in the aqueous phase of the suspension.

Flotation techniques can be applied where conventional gravity separation techniques fail. Indeed, flotation has supplanted the older gravity separation methods in solving a number of separation problems. Originally, flotation was used to separate sulphide ores of copper, lead, and zinc from associated gangue mineral particles. However, flotation is now also used for concentrating nonsulphide ores, for cleaning coal, for separating salts from their mother liquors, and for recovering elements such as sulphur and graphite.

During the past two decades, the application of flotation technology to mineral recovery in the United States has increased at an annual rate of about 7.4%. Indeed, present flotation installations in the United States alone are capable of processing almost two million (2,000,000) tons of material per day.

The preferred method for removing the floated material is to form a froth or foam to collect the bubble/particle aggregates. The froth containing the collected bubble/particle aggregates can then be removed from the top of the suspension. This process is called froth flotation and is conducted as a continuous process in equipment called flotation cells. Froth flotation is encouraged by the introduction into the flotation cell of voluminous quantities of small bubbles, typically in the range of about 0.1 to about 2 millimeters in diameter.

In conventional processes, the success of flotation has depended upon controlling conditions in the particulate suspension so that the air is selectively retained by one or more particle constituents and rejected by the other particle constituents of the suspension. To achieve this selectivity, the slurry or particulate suspension is typically treated by the addition of small amounts of known chemicals or flotation enhancing reagents which selectively render hydrophobic one or more of the constituents in the particulate suspension. Those chemicals which render hydrophobic a particulate constituent which is normally hydrophilic, are commonly referred to as "collectors." Chemical which increase the hydrophobicity of a somewhat hydrophobic particulate constituent are commonly referred to as "promoters."

Treatment with a collector or promoter causes those constituents rendered hydrophobic to be repelled by the aqueous environment and attracted to the air bubbles. Most importantly, the hydrophobic nature of the surface of these constituents enhances attachment of air bubbles to the hydrophobic constituents. Thus, control of the surface chemistry of certain particulate constituents by the addition of flotation enhancing reagents such as a collector or promoter allows for selective formation of bubble/particle aggregates with respect to those constituents.

Other chemicals or flotation enhancing reagents may be used to help create the froth phase for the flotation process. Such chemicals are commonly referred to as "frothers." The most common frothers are short chain alcohols, such as methyl isobutyl carbinol, pine oil, and cresylic acid. Important criteria related to the choice of an appropriate frother include the solubility and collecting properties of the frother, the toughness and texture of the froth, and froth breakage. An appropriate frother should thus be chosen to ensure that the froth will be sufficiently stable to carry the bubble/particle aggregates for subsequent removal as a flotation product or concentrate. (As used herein, the term "concentrate" refers to the mixture of desired mineral product and other entrained minerals which are present in the froth.) Additionally, the choice of frother should ensure a froth which will allow for proper drainage of water and for removal of misplaced hydrophilic particles from the froth. In practical flotation tests, the size, number, and stability of the bubbles during flotation may be optimized at given frother concentrations.

Thus, a complete flotation process is conducted in several steps: (1) a slurry is prepared containing from about five percent to about forty percent (5%–40% by weight) solids in water; (2) the necessary flotation enhancing reagents are added and sufficient agitation and time provided to distribute the reagents on the surface of the particles to be floated; (3) the treated slurry is aerated in a flotation cell by agitation in the presence of a stream of air or by blowing air in fine streams through the slurry; and (4) the aerated particles in the froth are withdrawn from the top of the cell as a froth product, and the remaining solids and water are discharged from the bottom of the flotation cell.

Much scientific endeavor has been expended toward analyzing the various factors which relate to improving the conditions during flotation in order to obtain improved recovery of particles. One particular phenomenon that has been known for some time is the poor flotation response of fine particles. This becomes economically important when flotation separation methods are used in the processing of minerals.

Generally, prior art processes have achieved flotation for both metallic and non-metallic minerals having particle sizes as large as about 1000 microns. In these processes, the minimum recoverable particle size has been anywhere from 10 to 100 microns, depending on the particular mineral sought to be recovered. One factor which is in large part determinative of this lower size limit and which has limited the extent of fine particle recovery is the relatively slow rate at which fine particles are separated in the prior art flotation processes. Frequently, the mineral industries have thus been forced to discard the smaller, unrecovered mineral particles since it is uneconomical to concentrate or recover them.

The economic losses suffered by the mineral industries due to this inability to recover very fine minerals by conventional flotation techniques is staggering. For example, in the Florida phosphate industry, approximately one-third ($\frac{1}{3}$) of the phosphate is typically lost as slime. Roughly one-fifth (1/5) of the world's tungsten and about one-half ($\frac{1}{2}$) of Bolivian tin is lost due to the inefficiencies of present flotation techniques in recovering these minerals.

The inability of prior art flotation processes to recover fine particles is also important in the coal industry. Flotation processes for separating ash and sulphur from coal have been used with greatly increased frequency during recent years. However, in these flotation separation processes, significant amounts of very fine coal particles go unrecovered. As a result, coal fines may be lost in the reject stream. Not only is this a waste of a valuable resource, but disposal of coal-containing reject streams is frequently a serious environmental problem.

Another factor which further complicates the effectiveness of conventional flotation is that conventional flotation cells generally require a minimal retention time of at least two minutes for successful separation. This is particularly disadvantageous because such relatively long retention times required for conventional flotation processes limit plant capacity and necessitate the construction of extremely large equipment which requires large floor space demands and tremendous capital and maintenance expenditures.

B. Froth Problems Encountered In The Prior Art Flotation Processes Conducted in a Centrifugal Field Efforts to provide an improved flotation process resulting in apparatus and methods which achieve flotation in a centrifugal field. For example, flotation has been conducted in a hydrocyclone-type device, yielding greatly improved flotation results over other prior art flotation apparatus. In such hydrocyclone systems, one very important factor is the formation and maintenance of a stable and quiescent froth. For example, once the bubble/particle aggregates formed in the hydrocyclone have been collected into a froth, interaction between the froth and the fluid flow within the cell can cause the destruction of a portion of the froth formed. The result is to reduce the amount of froth and mineral product recovered.

In prior art hydrocyclones, one region which typically experiences significant undesirable mixing between the fluid flow and the froth, is the point where fluid discharge is removed from the flotation cell. Another obvious point of interaction is the boundary layer between the froth and the fluid flow within the hydrocyclone. Any hydrocyclone apparatus or method which could minimize the mixing between the froth and the fluid flow experienced in the prior art, would be a significant advancement in the art.

Attempts to minimize froth destruction have typically resulted in systems which do not achieve the desirable level of bubble/particle collision and attachment. Prior art flotation cells have, therefore, not been designed in such a manner as to minimize froth disruption and yet promote bubble/particle collisions. This results in a compromise between the high intensity of agitation necessary for reasonable collision rates and the low intensity of agitation necessary to preserve the bubble/particle aggregates once formed. Attempts to reach such a compromise have resulted in the installation of intricate baffling systems in some prior art flotation apparatus to separate mixing zones from settling zones. Any apparatus which could minimize the interaction between the froth and fluid flow and still maintain high rates of collision so as to optimize bubble/particle attachment would thus be a significant advancement in the art.

Another problem experienced in the prior art is the problem of controlling the water split in the froth product. The water split may be defined as the ratio of the amount of water in the particle-containing froth product to the amount of water initially in the particulate suspension. Accordingly, it will be appreciated that low water splits are the most desirable.

Mixing between the fluid discharge and the froth within a hydrocyclone results in disadvantageously high water splits characterized by a relatively high amount of water in the froth. Moreover, it has been shown that high water splits are typically characteristic of poor flotation separation because a high proportion of fine gangue particles associated with the mineral to be treated, are entrained by the water into the froth. Thus, any hydrocyclone apparatus or method which could allow the water split to be carefully controlled would be an advancement in the art.

It would, therefore, be a significant advancement in the art to provide a flotation method and apparatus which minimize mixing between the fluid flow and the froth within the flotation vessel so as to maintain a more stable, quiescent froth within the vessel, while preserving the recent advancement in the art with regard to the flotation of relatively fine particles and relatively rapid flotation rates. It would be another advancement in the art to provide flotation methods and apparatus wherein the water split may be carefully controlled. Such an apparatus and method are disclosed and claimed herein.

BRIEF SUMMARY AND OBJECTS OF THE INVENTION

The present invention relates to flotation apparatus and methods wherein fluid discharge is removed annularly from the flotation vessel. Preferably, the apparatus comprises a generally vertically oriented, cylindrical flotation vessel having a tangential inlet at the upper end for introducing a particulate suspension into the vessel in generally tangential fashion. The vessel also includes an annular outlet at the lower end for directing fluid discharge from the particulate suspension out of the vessel in a generally annular fashion which minimizes the disturbance of the centrifugal flow of the fluid discharge. The apparatus further includes a pedestal positioned within the lower end of the vessel which serves to support the froth column formed within the flotation cell and to minimize mixing between the froth column and the fluid discharge. The annular outlet thus comprises an annular gap defined by the space between the pedestal and the inner surface of the wall of the vessel.

The configuration of the flotation vessel, with its tangential inlet and annular outlet, directs the particulate suspension around the vessel in a swirling motion such that the particulate suspension forms a thin fluid layer around the inner surface of the vessel wall. The configuration also directs the flow of the particulate suspension so as to create a forced vortex in the vessel; the forced vortex, in turn, forms a centrifugal field. A portion of the vessel wall is preferably formed as a porous wall, and the porous wall is surrounded by a gas plenum in communication with a gas source. Moreover, the pedestal mounted in the flotation vessel directs fluid discharge out of the vessel while supporting the froth column formed therein and while minimizing mixing between the froth and the fluid discharge which would cause destruction of the froth.

In the operation of the present invention, the particulate suspension is first introduced into the vessel through the tangential inlet and forms a thin fluid layer against the inside surface of the wall of the vessel. Gas inside the gas plenum is then injected through the porous wall and into the thin fluid layer of particulate suspension within the vessel. The air bubbles and hydrophobic particles within the fluid suspension form bubble/particle aggregates which float to the "top" of the centrifugal force field, i.e., the axial center of the vessel. The bubble/particle aggregates thus congregate at the core of the vessel to form a froth column which is removed axially from a vortex finder positioned at the top of the vessel.

As gas is sparged through the porous wall into the thin fluid layer of particulate suspension, very small air bubbles are formed by the high shear velocity of the particulate suspension against the porous wall. As the gas bubbles form at the porous wall, they are met by the directed flow of the particulate suspension so as to increase the collision rate between the gas bubbles and the particles in the particulate suspension. After formation and separation of the bubble/particle aggregates, the remaining fluid exits the annular outlet as discharge, with the annular outlet providing for smooth exit of the fluid discharge from the vessel so as to avoid interaction between the fluid discharge and the froth column within the vessel. At the bottom region of the vessel where the fluid discharge exits the annular outlet, the pedestal supporting the froth prevents mixing between the froth and the exiting fluid discharge in order to maintain the stability, quiescence, and integrity of the froth column.

Because of the annular fluid discharge and froth pedestal features of the present invention, as well as the forced vortex achieved in the present invention, the froth within the vessel is maintained as a stable, quiescent froth. Additionally, regulation of the diameter of the froth pedestal allows the water split to be controlled. Moreover, because of the thin fluid layer in which flotation occurs, flotation is achieved rapidly, and the retention time for the separation process within the vessel is on the order of seconds, rather than on the order of minutes.

It is, therefore, an object of the present invention to provide a flotation apparatus and method wherein the stability, quiescence, and integrity of the froth column are better established and maintained than in the prior art processes.

Another object of the present invention is to provide a flotation apparatus and method wherein a pedestal is positioned within the lower end of the vessel so as to minimize interaction and mixing between the fluid flow and the froth within the vessel.

A further object of the present invention is to provide a flotation apparatus and method wherein the fluid discharge is removed from the vessel in a generally annular fashion so as to provide for smooth fluid discharge from the vessel and to minimize mixing between the fluid flow and the froth within the vessel.

Still another object of the present invention is to provide a flotation apparatus and method wherein the fluid flow forms a forced vortex so as to enhance the formation of a stable and quiescent froth and wherein the water split may be carefully controlled.

Yet another object of the present invention is to provide a flotation apparatus and method which achieve flotation separation of fine particles which are at least as small, if not smaller than particles separated by prior art processes, and wherein such flotation separation is achieved much more rapidly than in prior art processes.

These and other objects and features of the present invention will become more fully apparent from the following description and appended claims, taken in conjunction with the accompanying drawings.

DETAILED DESCRIPTION OF THE PREFERRED EMBODIMENTS

Reference is now made to the drawings wherein like parts are designated with like numerals throughout. It will be readily appreciated that the components of the present invention as generally described and illustrated in the figures herein could be arranged and designed in a wide variety of different configurations. Thus, the following more detailed description of two embodiments of the apparatus and method of the present invention, as represented in FIGS. 1–2 and 3 is merely representative of two possible embodiments of the present invention.

Figure 1:
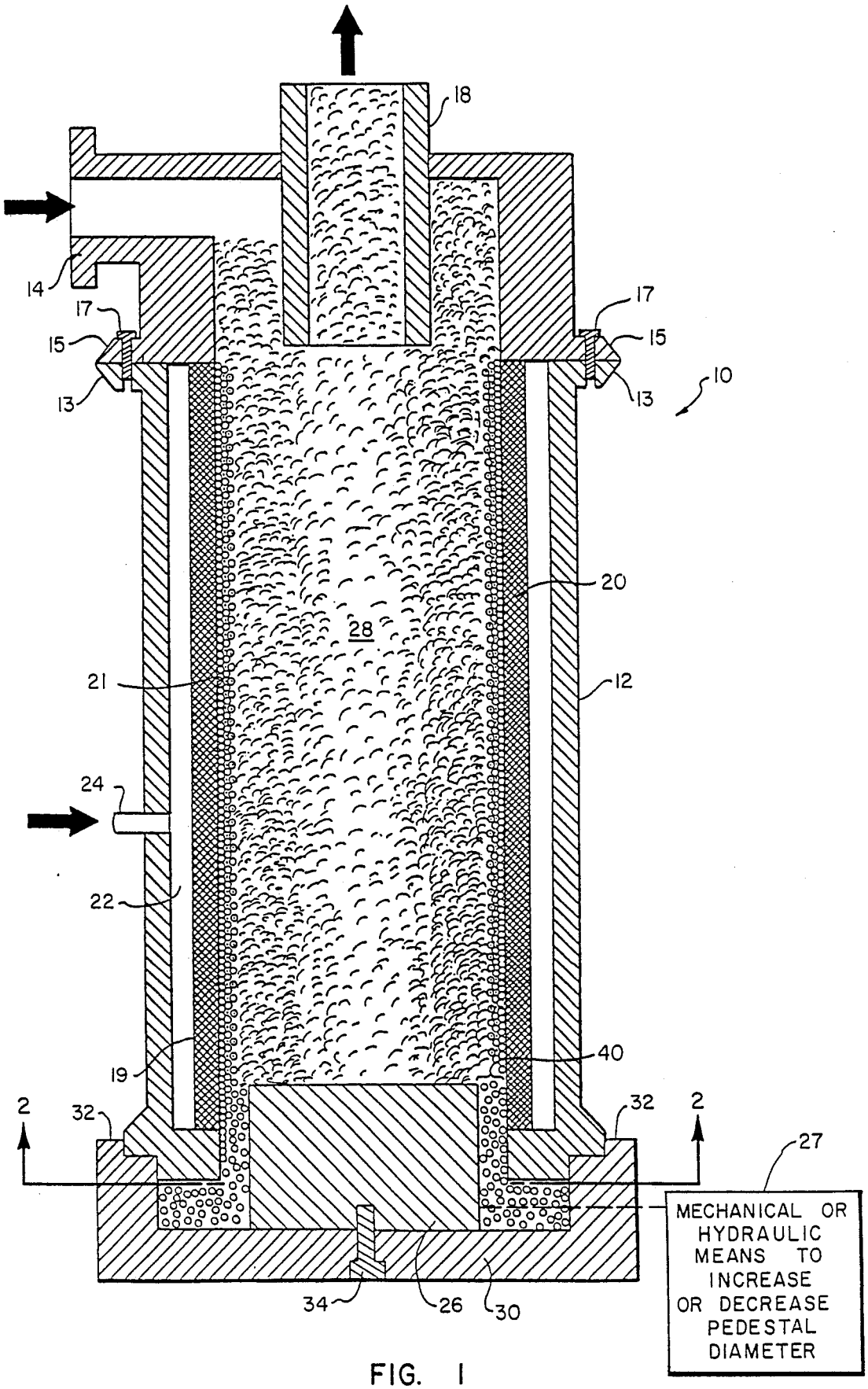
FIG. 1 is a vertical cross-sectional view of the presently preferred embodiment of the present invention.
Figure 2:
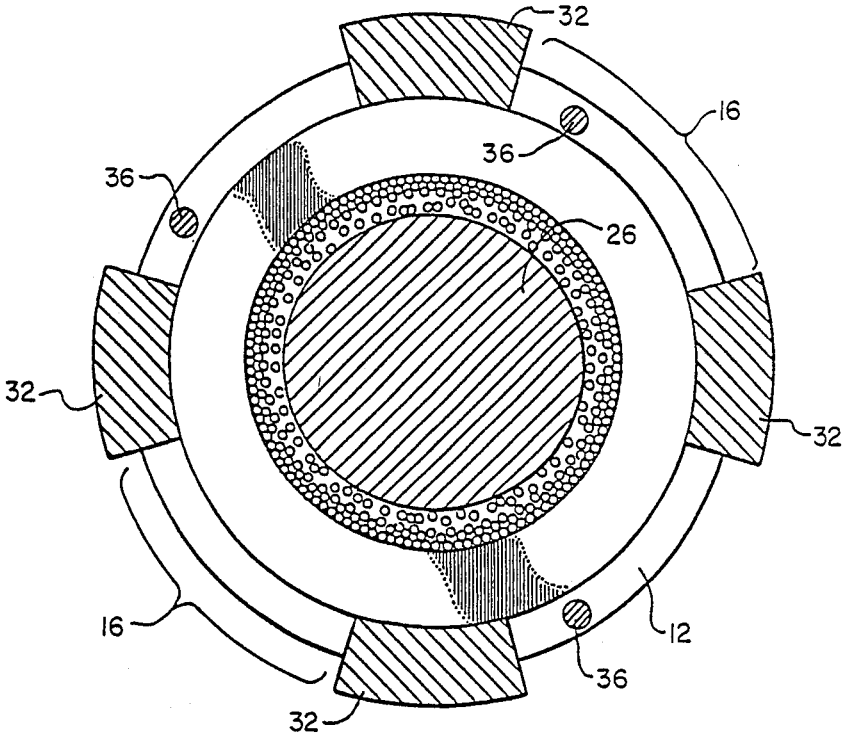
FIG. 2 is a horizontal cross-sectional view of the embodiment of FIG. 1 taken along line 2—2.
Figure 3:
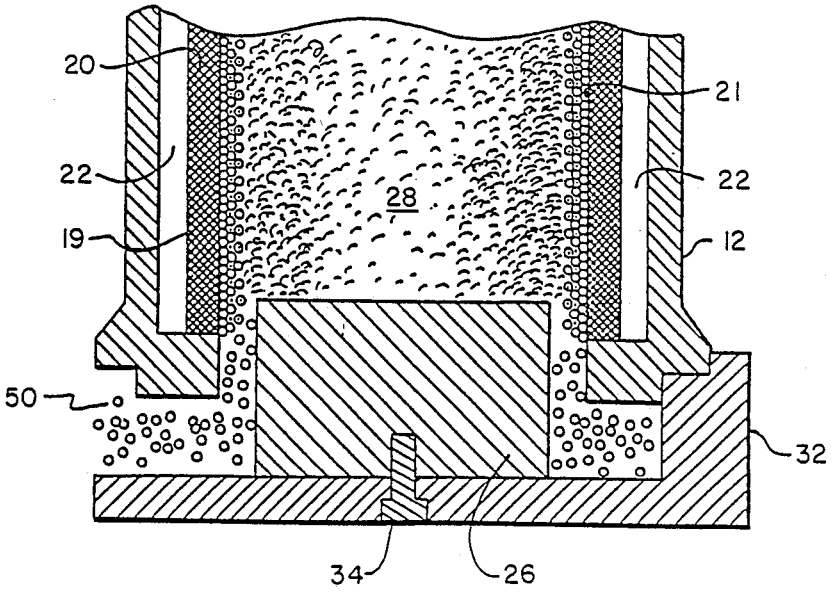
FIG. 3 is a partial cross-sectional view of a second embodiment of the present invention.

With specific reference to FIGS. 1 and 2, the presently preferred embodiment of the present invention is illustrated. The flotation apparatus, generally designated 10, includes a generally cylindrical housing or vessel 12 which is preferably vertically oriented. Housing 12 may be formed as an upper portion and a lower portion which are joined at flanges 13 and 15 by one or more bolts 17. A generally tangential inlet 14 is formed at the upper end of cylindrical flotation vessel 12 for receiving a particulate suspension.

A generally annular outlet is formed at the lower end of vessel 12 for directing fluid discharge from the particulate suspension out of vessel 12 in a generally annular fashion. In the embodiment of FIG. 1, the annular outlet comprises an annular gap 40 formed between a froth pedestal 26 and the inner wall of vessel 12, with the peripheral discharge passageways 16 formed between pedestal support 30 and the lower end of vessel 12 providing for final removal of the fluid discharge from vessel 12.

A portion of the wall of vessel 12 is preferably formed as a porous wall 20, having an outer surface 19 and an inner surface 21. An annular gas plenum 22 is formed between housing 12 and porous wall 20, with gas inlet 24 being formed in housing 12 to provide gaseous communication between a gas source (not shown) and gas plenum 22. A generally cylindrical vortex finder 18 is mounted to the upper end of flotation vessel 12, vortex finder 18 being hollow to permit the passage of froth therethrough.

Positioned within the lower end of vessel 12 is froth pedestal 26 for supporting a froth column 28 which is formed during the operation of apparatus 10. Froth pedestal 26 is preferably mounted to a pedestal support 30 (such as by a bolt 34), and the pedestal is centered within the lower end of vessel 12 by engaging a series of centering arms 32 formed around pedestal support 30 with the lower end of vessel 12. Centering arms 32 thus ensure the proper centering of froth pedestal 26 within vessel 12. As will be appreciated from the discussion hereinafter, centering of the pedestal within the vessel is important to minimizing the mixing between the froth and the fluid flow within the vessel and thus important to the optimum operation of flotation apparatus 10. In this arrangement, peripheral discharge passageways 16 are defined by the space between pedestal support 30 and the lower end of vessel 12. Additionally, vessel 12 may be secured to pedestal support 30 by any suitable means, for example by the use of connecting bolts 36 as shown in FIG. 2.

Still referring to FIGS. 1 and 2, the operation of flotation apparatus 10 and one preferred embodiment of the method of the present invention can best be understood. A particulate suspension (sometimes referred to as a "slurry feed") containing finely divided particles is introduced into vessel 12 through tangential inlet 14 so as to assume a swirling flow path around inner surface 21 of porous wall 20. The particulate suspension is introduced under pressure so as to create a relatively strong centrifugal force field. In certain experiments (reported in FIG. 4 and discussed in more detail hereinafter), the particulate suspension was introduced into a flotation vessel having a 1.85 inch diameter at a feed rate between about 10 and about 16 gallons per minute, producing centrifugal force fields between about 70 G and about 200 G. It is anticipated that centrifugal force fields which are smaller or larger than these values may also be employed in the present invention; these values are given by way of example only, not by way of limitation. The particulate suspension contains one or more particulate constituents to be separated. The particulate constituents to be separated should either be naturally hydrophobic or rendered hydrophobic by the addition of a promoter or collector or by other methods known in the art. Other particles which may be present in the particulate suspension, and which are not desired to be recovered, should be left hydrophilic.

After injecting the particulate suspension into inlet 14 under pressure and in a generally tangential fashion so as to impart a swirling motion to the particulate suspension, the particulate suspension forms a thin fluid layer against inner surface 21 of porous wall 20. Gas (e.g., air or any other gas which will not react adversely with the particulate suspension) is introduced through gas inlet 24 into gas plenum 22 and through porous wall 20 into the thin fluid layer of particulate suspension against surface 12 of porous wall 20.

Upon entry into the thin fluid layer of particulate suspension, the gas forms small bubbles which attach to and/or entrain the hydrophobic particles and transport them in the centrifugal field to the axial center of vessel 12. The hydrophilic particles do not attach to the gas bubbles and follow the swirl flow of the thin fluid layer in the centrifugal field along the inner surface 21 of porous wall 20. The hydrophilic particles follow the thin fluid layer of particulate suspension downwardly and leave the vessel 12 annularly with the fluid discharge through annular outlet 16. The hydrophobic particle/bubble aggregates congregate at the core of vessel 12 to form a froth column 28. The froth column is supported by froth pedestal 26, travels upwardly through vessel 12, and is discharged from the vessel through vortex finder 18.

In this regard, it will be noted that a particular particulate constituent can be recovered from a particulate suspension by the flotation techniques of the present invention even though that particular constituent comprises particles having a broad range of particle sizes and even though there may be other particulate constituents in the particulate suspension which are smaller or within the same range of particle sizes.

Within the swirling layer of fluid within vessel 12, a mass gradient exists because of the centrifugal force field created within the vessel. The region closest to porous wall 20 contains mostly water, whereas the region nearest the core of vessel 12 contains mostly gas bubbles. The particles introduced with the particulate suspension are distributed within the swirling fluid layer based on their density, size, shape, and interaction with air. Hence, the large hydrophilic particles are forced towards porous wall 20, while the small hydrophilic particles are distributed throughout the thin fluid layer according to their mass. Hydrophobic particles form particle/bubble aggregates and thus migrate towards the core of vessel 12.

The removal of the fluid discharge from vessel 12 through the annular outlet occurs in a very smooth fashion due to the annular configuration of gap 40 and the peripheral location of passageways 16. Since the centrifugal flow of swirling fluid within vessel 12 moves around the inner circumference of the vessel, peripheral discharge passageways 16 provide a natural escape for the fluid discharge, thereby allowing the fluid discharge to exit the vessel without disrupting fluid flow within the vessel. Additionally, such smooth discharge avoids the pooling or accumulation of fluid discharge within the bottom of the vessel which is a cause for disruption of the fluid flow in such prior art apparatus as the hydrocyclone. Importantly, the smooth centrifugal flow of fluid within vessel 12 and the smooth exiting of fluid discharge from the vessel cause minimal disturbance of froth 28, thereby preserving the stability, quiescence, and integrity of the froth.

From the foregoing, it will be recognized that the term "annular outlet" as used herein thus refers to an outlet which allows for smooth exit of the fluid discharge from vessel 12 without substantial disruption of the fluid flow within the vessel. As discussed previously, the "annular outlet" of the embodiment of FIG. 1 comprises annular gap 40, with peripheral discharge passageways 16 providing for final removal of the fluid discharge from vessel 12. Although, in FIG. 2, peripheral discharge passageways 16 are shown forming an interrupted circular pattern, the configuration of the passageways 16 may be modified to achieve minimum disruption of fluid flow within the vessel in a given particular application of the present invention. Thus, it will be appreciated that the present invention may contemplate the presence of structural support members such as centering arms 32 shown in FIG. 2 which may partially obstruct the peripheral discharge to form passageways 16. Indeed, the present invention could even comprise a series of tangential outlets around the periphery of the vessel bottom, the tangential outlets being defined by a plurality of support members or dividing members mounted to the vessel bottom.

A second embodiment of the method and apparatus of the present invention is illustrated in FIG. 3. This embodiment is similar to the preferred embodiment of FIGS. 1 and 2 except that a tangential discharge passageway 50 is used in lieu of peripheral discharge passageways 16. Thus, in the embodiment of FIG. 3, the "annular outlet" is defined by annular gap 40, with tangential discharge passageway 50 providing for final removal of fluid discharge from vessel 12. This embodiment operates similarly to the preferred embodiment of FIGS. 1 and 2 except that the fluid discharge is removed through tangential discharge passageway 50 instead of peripheral discharge passageways 16.

Referring now more particularly to FIGS. 1 and 2, froth pedestal 26 acts to further direct the fluid discharge through the annular outlet in a smooth fashion. The vertical surface area around froth pedestal 26 defines annular gap 40 with the wall of vessle 12 and provides a guide for directing the fluid discharge through gap 40. Moreover, the froth pedestal supports froth column 28 at a distance well away from the fluid discharging through peripheral discharge passageways 16. Upon entering annular gap 40, the fluid discharge becomes isolated from froth 28 while the froth remains supported at the top horizontal surface of froth pedestal 26. Thus, froth pedestal 26 acts to minimize mixing between froth 28 and the fluid discharge, thereby preserving the stability, quiescence, and integrity of froth 28.

Advantageously, froth pedestal 26 may be configurated so as to enable one to increase or decrease its diameter. This may be accomplished, for example, by construction pedestal 26 of flexible material which may be mechanically or hydraulically expanded and contracted by a suitable means 27 so as to effectively increase or decrease the diameter of pedestal 26. Alternatively, the diameter of froth pedestal 26 may be "adjusted" by removing bolt 34, replacing the existing froth pedestal withone of a different diameter, and inserting bolt 34 back into position so as to anchor the new froth pedestal to pedestal support 30.

There are many advantages to configurating froth pedestal 26 so as to have an adjustable diameter. For example, the water split can be manipulated and carefully controlled by changing the diameter of the froth pedestal. When the diameter of the froth pedestal is smaller, less material is transported to froth 28 in the overflow exiting vortex finder 18, thus resulting in a smaller water split.

Thus, by adjusting the diameter of froth pedestal 26, one can select the portion of the mass gradient within vessel 12 which is to be forced upwards with froth 28 into the overflow. With a relatively small diameter, froth pedestal 26 will allow only relatively low mass material, e.g., air bubbles, bubble/particle aggregates, and fine hydrophilic particles, to be transported to the overflow via froth 28. With a relatively large diameter, froth pedestal 26 intersects the mass gradient closer to porous wall 20, thereby forcing material of relatively high mass into the overflow via froth 28. Small pedestal diameters tend to yield higher grade products with lower recoveries, while larger pedestals result in high recoveries with relatively low grades. Thus, the trade off between recovery and grade can be determined experimentally by varying the size of froth pedestal 26 in a given application, thereby allowing greater flexibility in achieving the desired amount and the desired ratios of the water and the particulate constituents in the overflow, as compared to prior art processes.

It will be recognized that froth pedestal 26 may also be tapered and configured of varying heights, from pedestals shorter than that illustrated in FIG. 1 to pedestals taller than that illustrated in FIG. 1. The important features of the froth pedestal are support for the froth column and an outlet means which are provided between the froth pedestal and the vessel.

Additionally, froth pedestal 26 may be rotatably mounted to pedestal support 30 such that pedestal 26 is free to rotate around the axis of cylindricla vessel 12. Moreover, driving means (not shown) may be provided to rotate froth pedestal 26. Rotation of froth pedestal 26 decreases the friction between the swirling fluid discharge exiting the annular outlet and froth pedestal 26, thereby providing for an even smoother exit of fluid discharge from the annular outlet.

Moreover, froth pedestal 26 may be configurated with a spring-loading system which would allow the pedestal to be partially ejected through a hole formed in pedestal support 30 to relieve pressure build-up within annular gap 40. Thus, if annular gap 40 becomes plugged with particles during operation, the presure build-up would cause pedestal 26 to be pushed downwardly through the hole in support 30 so as to permit flushing of the material clogging annular gap 40. Alternatively, such a flushing feature could be provided by hydraulically actuating froth pedestal 26 in lieu of using a spring-loading system.

The apparatus and method of the present invention further serve to maximize the attachment of the hydrophobic particles in the particulate suspension to the gas bubbles. By maximizing the attachment of the hydrophobic particles to the air bubbles to form bubble/particle aggregates, the degree of separation of the hydrophobic particles from the particulate suspension is increased. This is due in part to the fact that flotation occurs in a centrifugal field, where the probability of collision and subsequent attachment of the gas bubbles to hydrophobic particles is greatly enhanced. Thus, the present invention takes full advantage of the affinity of the hydrophobic particles for the gas bubbles in achieving maximal separation of the hydrophobic particles.

It will be appreciated that the same apparatus and method may be used to separate finely divided hydrophobic particles, or finely divided particles which are made hydrophobic, from a particulate suspension containing no other particles. In such an application, there are, of course, no hydrophilic particles in the fluid discharge. For example, the present invention may be used in sulfur recovery processes or in the treatment of waste water.

There are several other significant advantages associated with the novel apparatus and method of the present invention. For example, the generally tangential orientation of inlet 14 and the generally annular configuration of the annular outlet cause the injected particulate suspension to form a forced vortex within vessel 12 such that the forced vortex creates a centrifugal field.

In a forced vortex system, the whole fluid system rotates at the same angular velocity. Hence, a forced vortex system results in a wheel-like motion with the tangential velocity of the fluid decaying to zero in the direction of the axial center of the apparatus. In a free vortex system, however, the tangential velocity is maximal at an intermediate distance from the center of the apparatus. Consequently, a more stable and quiescent froth is more easily formed and maintained in a forced vortex system than in a free vortex system.

Another advantage of the present invention is the careful control over the water split which is achieved. As mentioned previously, it is highly desirable to minimize the water split, thereby minimizing the amount of water in froth 28 and the amount of water carried with the desired product to the overflow. From the discussion herein, it will be appreciated that the water split can be controlled in the present invention by adjusting the diameter of froth pedestal 26.

Another important factor to controlling the water split as achieved in the present invention is the separation of froth 28 from the fluid discharge by froth pedestal 26. As mentioned above, the froth pedestal minimizes the mixing between the fluid discharge and the froth at the point of discharge from the vessel, and it serves to keep froth 28 at a significant distance from the fluid discharge exiting the annular outlet. Because of these functions of the froth pedestal, the amount of water communicated from the fluid discharge to froth 28 is minimized.

Moreover, the annular outlet also contributes significantly to controlling the water split as achieved in the present invention. Removing the fluid discharge annularly from vessel 12 results in even less interaction between the fluid flow and the froth within the flotation vessel; thus, even less water is entrained in the froth and carried to the overflow by the froth column.

Another important factor involved in controlling the water split is the generally cylindrical configuration of vessel 12 and the tangential orientation of inlet 14, in combination with the annular configuration of the annular outlet. A tangential inlet and annular outlet assure that the particles in the particulate suspension will be subjected to sufficient centrifugal forces to minimize the entrance of water into the froth. The vertical orientation of the flotation vessel helps to maximize the drainage of fluid from froth column 28 as it moves upwardly in a vertical direction; the vertical orientation of the flotation vessel utilizes gravity to its maximum extent to act on the water in froth column 28.

As the bubble/particle aggregates reach the core of vessel 12, they congregate to form froth 28 which is directed upwardly by froth pedestal 26 towards vortex finder 18, froth 28 exiting vessel 12 therethrough. Since froth 28 travels countercurrently to the thin fluid layer of particulate suspension and since the vessel 12 is vertically oriented, water drainage from froth 28 is further enhanced. The result is even further minimization of the water split.

The thin fluid layer of the particulate suspension characteristic of the present invention has a relatively small width such that, generally, froth 28 occupies more than 90% of the volume of vessel 12 inside the thin fluid layer of particulate suspension, with the thin fluid layer thus comprising less than 10% of the volume of the vessel.

There are several advantages which result from the swirling thin fluid layer of particulate suspension. As gas is introduced from gas plenum 22 through porous wall 20 and into the thin fluid layer of particulate suspension, small air bubbles are formed along the inner surface 21 of porous wall 20. The high sheat velocity of the thin fluid layer of the particulate suspension against surface 21 of porous wall 20 creates a continual generation of very small gas bubbles and provides for intense contact between the hydrophobic particles and the gas bubbles within the thin fluid layer. It will be understood that the generation of the large number of very small gas bubbles is due, in large measure to the high shear velocity of the thin fluid layer of particulate suspension against porous wall surface 21.

Another important factor in achieving the generation of a large number of small gas bubbles is the pore size of the pores formed in porous wall 20. Presently, pore sizes of about 1 to 10 microns have yielded satisfactory results in terms of producing small gas bubbles. It is anticipated, however, that pore sizes outside this range may also be suitable in producing the voluminous quantities of small gas bubbles needed.

Moreover, during formation of the gas bubbles at porous wall 20, the particulate suspension is directed towards the gas bubbles, thereby causing intense bubble-particle interaction. The intense bubble-particle interaction caused by the directed motion of the particulate suspension towards the gas bubbles, together with the high shear velocity of the particulate suspension against porous wall 20, considerably increases the probability of collision between the gas bubbles and the hydrophobic particles in the thin fluid layer of particulate suspension. In conventional flotation cells, gas bubbles and particles are mixed together at random, and the probability that a particle and bubble will meet with sufficient velocity to form a particle/bubble aggregate is considerably less than the probability that such an occurrence will take place in the thin fluid layer system of the present invention.

Additionally, since the thin fluid layer of the present invention generally occupies less than 10% of the volume of vessel 12, flotation is achieved rapidly. This is because the gas bubbles need only arrive at the boundary between the thin fluid layer and froth 38 before flotation is complete. Indeed, flotation is achived 50 to 100 times and sometimes as much as 300 times faster in the present invention than in most conventional flotation cells. For example, the present invention has been used to achieve flotation of about 80% of the copper sulphisde in a copper morphyry ore sample in about one second or less. (See the experimental results reported in FIG. 4, discussed in more detail hereinafter.) Prior art processes typically require about 10 to 15 minutes for such a separation.

It will be appreciated that the annular outlet accommodates the maintenance of the thin fluid layer of particulate suspension, by permitting discharge in such a manner and at such a rate as to not disturb the thin fluid layer. Since the centrifugal flow of the thin fluid layer within vessel 12 moves around the inner circumference of the vessel, annular gap 40 and peripheral discharge passageways 16 provide for the smooth exit of fluid discharge from the vessel without disturbing the thin fluid layer and while preventing pooling in the bototm of the vessel. Moreover, froth pedestal 26 also serves to accommodate the thin fluid layer by directing the fluid discharge smoothly out of vessel 12. In particular, annular gap 40 between froth pedestal 26 and vessel 12 is slightly larger than the thin fluid layer and serves to accommodate the thin fluid layer and direct it towards peripheral discharge passageways 16. The width of this gap 40 may be changed by adjusting the diameter of froth pedestal 26 as explained hereinabove. Thus, annular gap 40 may be adjusted according to the particular width of the thin fluid layer within vessel 12.

As mentioned previously, the retention time of the particulate suspension from the time it enters inlet 14 to the time the fluid discharge exits peripheral discharge passageways 16, is a matter of seconds, thus providing for a much more rapid separation than is achieved in most conventional flotation cells. This, in turn, allows flotation apparatus 10 to be constructed much smaller than conventional flotation cells, thereby eliminating the need for large floor space to operate the apparatus. It will be appreciated that the retention time is also influenced by the length of porous wall 20 and the amount of gas sparged therethrough. Consequently, porous wall 20 may be constructed with a length that will provide the most desirable retention time for a given application.

Figure 4:
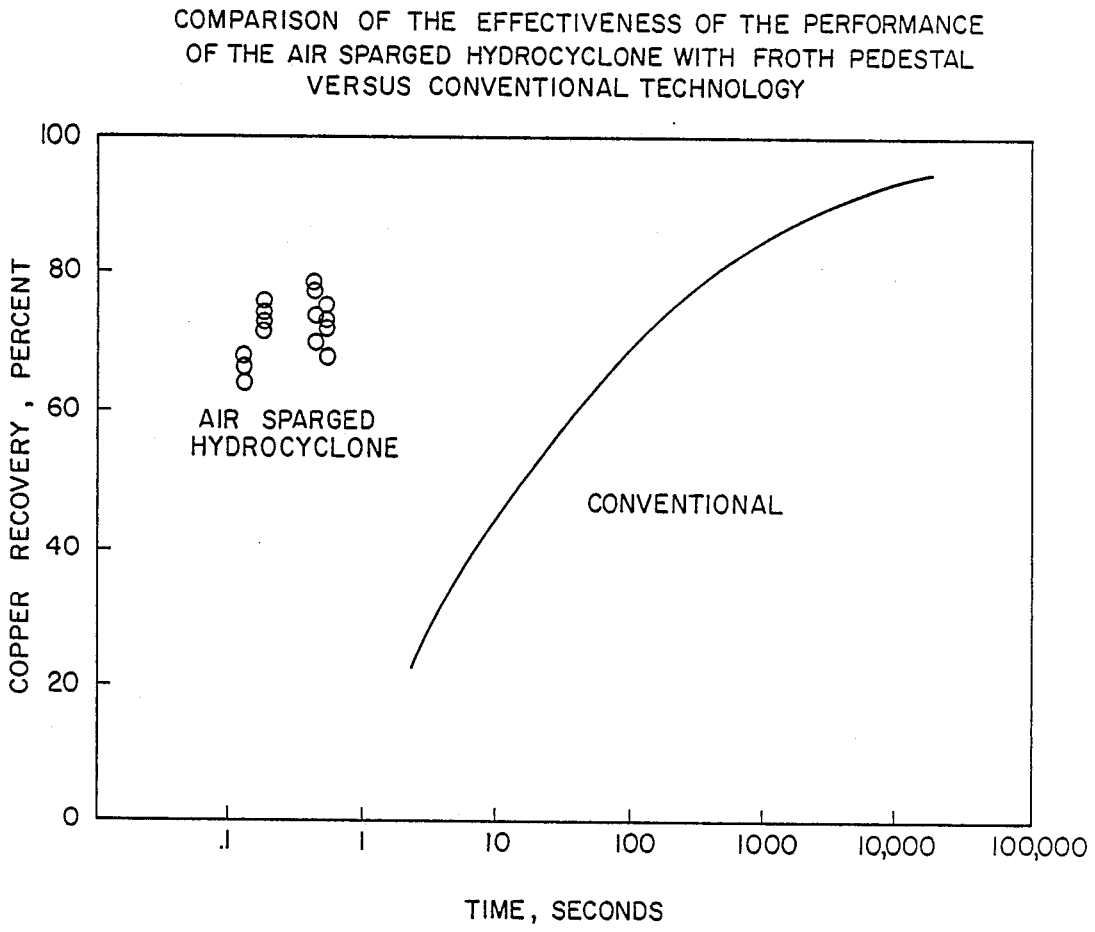
FIG. 4 is a graph comparing the experimental flotation rate and recovery using the apparatus and method of the present invention versus the experimental flotation rate and recovery of conventional flotation processes.

The rapid flotation rates achieved by the present invention, as compared to flotation rates of prior art processes, more graphically illustrated in FIG. 4. The comparative data graphed in FIG. 4 presents a comparison of the performance of an air sparged hydrocyclone (with froth pedestal) of the type illustrated in FIG. 1 with the performance that would be expected to be obtained in a conventional continuous flotation cell (as predicted by an analysis of twenty batch flotation tests). The one slurry used in this comparative testing was prepared using a typical western copper porphyry ore.

The data in FIG. 4 for a typical conventional flotation process is based upon a series of batch flotation tests using a five liter Galigher flotation cell having a 10.5 centimeter impeller agitator. The impeller was operated at about 700 rpm, and the air flow was about 9 standard liters per minute. Head analyses of the ore used in these tests showed a copper content in the range of about 0.58 to 0.72%. The fineness of the ore varied in the tests in the range of about 58.4 to 66.5% not passing 400 mesh.

The reagents used during the batch flotation tests included lime, sodium cyanide ("NaCN"), kerosene, and a frother (Dowfroth 1012). Lime was added such that the pH was about 8.8; the amounts of the other reagents varied within the following parameters:

NaCN: 0.015–0.050 lb/ton
Frother: 0.68–2.32 lb/ton
Kerosene: 0.8 lb/ton

A collector was added to the slurry in an amount of about 0.05–0.08 lb/ton. The slurry contained between about 8.9–9.8% solids and was conditioned for between about five (5) and fifteen (15) minutes prior to the initiation of a test. Samples of the concentrate were taken at 20, 60, 180, and 360 secnds after the introduction of the air. The concentrate samples were analyzed and the results were extrpolated so as to represent the results which would be obtained in a continuous flotation device.

The curved line in FIG. 4 indicates the maximum test results which were obtained. The percent of copper recovery is plotted versus the flotation time necessary to achieve that recovery; note that the time is plotted exponentially. These results are consistent of the expected behavior of such a copper porphyry ore in large industrial flotation equipment.

The data reported in FIG. 4 for the performance of the air sparged hydrocyclone with froth pedestal were obtained on an apparatus such as illustrated in FIG. 1. The air sparged hydrocyclone had a diameter of 1.85 inches and a length of between 16 and 38 inches (depending upon the particular test). The pedestal diameter was varied between 1.68 and 1.70 inches.

Head analyses of the ore used in these tests showed a copper content in the range of about 0.48–0.70%. The fineness of the ore varied in the tests in the range of about 55.12–68.4% not passing 400 mesh. The conditioning reagents were the same as with the previous tests except that the amounts used varied within the following parameters:

NaCN: 0.021–0.025 lb/ton
Frother: 1.4–1.7 lb/ton
Kerosene: 0.72–0.85 lb/ton

The slurry was then conditioned for about five (5) minutes prior to the initiation of a test. A collector was added to the slurry in an amount of about 0.0–0.08 ml/kg.

The slurry, having between about 5.2 and 11.3% solids, was then pumped into the air sparged hydrocyclone apparatus at a slurry feed rate of between about 75 and 160 lb/min; this corresponds to between about ten and sixteen gallons of slurry perminute through the 1.85 inch diameter air sparged hydrocyclone. (The resultant centrifugal forces were calculated to be in the range of about 70–200 G.) The air flow rate was beteen about 4.3 and 8.5 SCFM.

As illustrated in FIG. 4, high recovery rates were achieved in very short time periods. What is particularly noteworthy is that the difference in the residence time in the flotation apparatus of the present invention was about three orders of magnitude at a recovery of 70–80% with comparable grades. The copper grade (weight percent copper in the concentrate) was about 3.9–10.6% in the air sparged hydrocyclone of the present invention and about 2.9–6.9% in the conventional apparatus.

It will be understood that the present invention may be embodied in other specific forms without departing form its spirit or essential characteristics. The described embodiments are thus to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A flotation method for separating particles from a particulate suspension, comprising the steps of:

obtaining a vessel having a generally circular cross-section and a generally vertical orientation;

introducing a particulate suspension into an upper end of the vessel in a generally tangential fashion;

introducing gas into the particulate suspension inside the vessel adjacent a wall of the vessel, the gas forming small bubbles which separate particles from the particulate suspension by flotation, thereby leaving a fluid discharge, the separated particles and bubbles forming a froth within the vessel;

positioning a pedestal having a generally circular cross-section within a lower end of the vessel so as to direct the fluid discharge out of the lower end of the vessel in a generally annular fashion such that the fluid discharge does not substantially disturb the fluid flow within the vessel, the pedestal serving to minimize mixing between the froth and the fluid discharge;

removing the froth from the vessel; and controlling the amount of material leaving the vessel in the froth and the amount of material leaving the vessel in the fluid discharge by adjusting the diameter of the pedestal.

2. A flotation method for separating particles from a particulate suspension as defined in claim 1 wherein the vessel comprises a generally cylindrical vessel, and wherein the pedestal has a generally cylindrical configuration.

3. A flotation method for separating particles from a particulate suspension as defined in claim 1 wherein at least a portion of a wall of the vessel is a porous wall, and wherein the gas introducing step comprises sparging gas through the porous wall and into the particulate suspension within the vessel, the gas forming small bubbles within the particulate suspension.

4. A flotation method for separating particles from a particulate suspension as defined in claim 1 wherein the froth removing step comprises removing the froth from a coaxial outlet formed in the upper end of the vessel.

5. A flotation method for separating particles from a particulate suspension as defined in claim 1 further comprising the steps of:

mounting a pedestal support to the lower end of the vessel such that a peripheral discharge for allowing removal of the fluid discharge from the vessel is formed between the lower end of the vessel and the pedestal support; and mounting the pedestal to the pedestal support.

6. A flotation method for separating particles from a particulate suspension as defined in claim 1 further comprising the step of removing fluid discharge form a tangential discharge of the vessel.

7. A flotation method for separating particles from a particulate suspension as defined in claim 1 further comprising the step of centering the pedestal within the lower end of the vessel.

8. A flotation method for separating hydrophobic particles from a particulate suspension, comprising the steps of:

obtaining a generally cylindrical vessel having a generally vertical orientation, at least a portion of a wall of the vessel comprising a porous wall;

introducing a particulate suspension into an upper end of the vessel in a generally tangential fashion;

sparging air through the porous wall and into the particulate suspension within the vessel, the air forming small bubbles which form bubble/particle aggregates with hydrophobic particles in the particulate suspension;

collecting the bubble/particle aggreagates to form a froth;

directing the fluid discharge out of a lower end of the vessel in a generally annular fashion such that the fluid discharge does not substantially disturb the fluid flow within the vessel;

minimizing mixing between the froth and the fluid discharge by positioning a generally cylindrical pedestal within the lower end of the vessel, the pedestal serving to direct the froth upwardly through the vessel and to guide the fluid discharge out of the vessel, the pedestal providing for directing the fluid discharge out of the lower end of the vessel in an annular fashion;

mounting a pedestal support to the lower end of the vessel such that a peripheral discharge for allowing removal of the fluid discharge from the vessel is formed between the lower end of the vessel and the pedestal support;

mounting the pedestal to the pedestal support;

centering the pedestal within the lower end of the vessel;

controlling the amount of material leaving the vessel in the froth and the amount of material leaving the vessel in the fluid discharge by adjusting the diameter of the pedestal; and removing the froth from a coaxial outlet formed in the upper end of the vessel.

* * * * *

UNITED STATES PATENT AND TRADEMARK OFFICE

CERTIFICATE OF CORRECTION

PATENT NO. : 4,744,890

DATED : May 17, 1988

INVENTOR(S) : Jan D. Miller et al.

It is certified that error appears in the above-identified patent and that said Letters Patent is hereby corrected as shown below:

Column 10, line 34, "presure" should be --pressure--
Column 12, line 6, "high sheat" should be --high shear--
Column 13, line 51, "0.050" should be --0.030--
Column 13, line 61, "extrpolated" should be --extrapolated--
Column 14, line 46, "form" should be --from--

Signed and Sealed this

Twenty-seventh Day of June, 1989

*Attest:*

*Attesting Officer*

DONALD J. QUIGG

*Commissioner of Patents and Trademarks*